United States Patent [19]

Ball

[11] 4,034,493

[45] July 12, 1977

[54] FLUID NOVELTY DEVICE

[75] Inventor: Derek W. Ball, San Rafael, Calif.

[73] Assignee: Wham-O Mfg. Co., San Gabriel, Calif.

[21] Appl. No.: 626,644

[22] Filed: Oct. 29, 1975

[51] Int. Cl.[2] ..... G09F 13/24

[52] U.S. Cl. ..... 40/106.21

[58] Field of Search ..... 40/106.21, 326; 46/41

[56] References Cited

U.S. PATENT DOCUMENTS

| | | | |
|---|---|---|---|
| 2,569,078 | 9/1951 | Silver | 40/106.21 |
| 3,564,740 | 2/1971 | Calfee | 40/106.21 |
| 3,570,156 | 3/1971 | Walker | 40/106.21 |
| 3,738,036 | 6/1973 | Landsinger | 40/106.21 |

*Primary Examiner*—Hugh R. Chamblee

*Assistant Examiner*—Wenceslao J. Contreras

*Attorney, Agent, or Firm*—Christie, Parker & Hale

[57] ABSTRACT

A display device consisting of a sealed chamber defined by two closely spaced panes or plates of a transparent or translucent material. Liquids of different specific gravities and selected viscosities are located in the chamber. In operation, the device is inverted and the liquid of the heavier specific gravity flows through the liquid of the lighter specific gravity in distinct, spaced apart beads or droplets under the influence of gravity. The downward flow of the heavier liquid causes the upward displacement of the lighter liquid. A series of obstructions of various shapes and geometric configurations are interposed in the flow path of the heavier liquid to change its flow path and create the visual display.

13 Claims, 4 Drawing Figures

FLUID NOVELTY DEVICE

BACKGROUND OF THE INVENTION

This invention relates to display devices and in particular to a visual effect device utilizing a sealed narrow chamber and the movement of a liquid of one specific gravity with respect to a liquid of a second specific gravity within the chamber.

The present invention belongs to a category of devices which utilize visual effects produced when two contrastingly colored liquids, immiscible in one another, are placed in a container and subjected to physical action such as heating, shaking, change of orientation and the like.

One example is a device known under the commerical name "Lava Lamp." this case two contrastingly colored, immiscible liquids are contained in a bottle-like chamber with a heat source located in the base. The heat from the source causes one of the two liquids to in an effect "boil," producing a slow but observable upward flow of large globules of the one liquid relative to the other. Upon moving away from the heat source, the globules cool and tend to settle toward the heat source. Thermal currents in the liquids produce an ever changing geometry of the globules. Light directed through the bottle-like chamber enhances the visual effect produced. When the globules settle they are again reheated and the process repeats itself producing a continuously changing display until the heat is removed.

Other devices utilize the influence of gravity to produce visual effects. One such device is of the type described in U.S. Pat. No. 3,564,740 in which a multi-compartment display device is provided with liquids of different specific gravities stored therein. The visual effect produced by the relative movement of the liquids is obtained by inverting the device like an hour glass to produce the gravity flow of the heavier liquid in the downward direction with the consequent upward displacement of a lighter liquid. The flow of liquids is accomplished by a valving or porting arrangement in barriers or partitions which divide the several compartments of the display device, one from the other.

The relative flow of liquids of different specific gravities akin to that utilized in the Calfee U.S. Pat. No. 3,564,740 is utilized by the present invention, but with several important differences. In the first instance the beading or droplet forming action is provided by the liquids themselves as the heavier liquid flows around baffles and obstructions in its flow path without the use of ports or valves of any kind. In addition, beacuse the invention utilizes a pair of plates defining a narrow chamber for the liquids, the color contrast and visual effect is maximized because each of the liquids abuts the inside surfaces of the plates and are viewed directly through the plates. In Calfee one liquid flows through the other interiorly of the container walls and the view thereof is obscured to the extent that the line of sight to the drops of the first liquid passes through said other liquid.

The present invention eliminates the use of special ports or valves single or in symmetrical pairs and utilizes a reservoir at one end and a main chamber. A simple opening or aperture in the barrier defining the boundary between reservior and main chamber provides the means for communicating liquids between reservoir and chamber. Each aperture in combination with an associated baffle in turn provides the means for splitting the flow from the reservoir into a multiplicity of slow paths extending from top to bottom of the display device, adding immeasurably to the dynamic visual effect produced. Finally, the present invention is a substantial improvement over the Calfee device in providing liquid combinations utilizing liquids other than water in that it has been found that formulations of water and oil as prescribed by Calfee will not produce the droplet or beading effect characteristic of the present invention without special ports or valves.

SUMMARY OF THE INVENTION

The present invention provides a display apparatus comprising a sealed container defined by two closely spaced apart translucent plates having a main chamber and at least one reservoir located at one end of the chamber with the reservoir having at least one aperture opening into the main chamber. A first liquid of a first specific gravity is contained within the container. A second liquid of a second specific gravity lighter than said first specific gravity is contained within the container, the second liquid being immiscible in said first liquid and having a predetermined viscosity. At least one obstruction of a thickness equal to the depth of the main chamber is disposed in the main chamber in a fluid flow path extending from the aperture. The obstruction is oriented within the chamber such that the first liquid is caused to be broken into beads of liquid as it moves past the obstrucion.

The present invention achieves a dynamic visual display utilizing a minimum number of structural elements. By utilizing two plates of a transparent or translucent material and by separating and sealing the plates with strips of the same material located around the border of the plates, a chamber which is a fraction of an inch wide is thereby defined. Additional strips of the material equal to the depth of the chamber located interiorly of the apparatus provide baffles and define the main chamber and the reservoirs. As the heavier liquid is metered from the baffles it follows various paths depending upon the geometry of obstructions located in the main chamber, producing the visual display, as for example, a maze effect.

DESCRIPTION OF THE DRAWINGS:

These and other advantages of the present invention will be better understood by reference to the figures of the drawing wherein.

Figure 1:
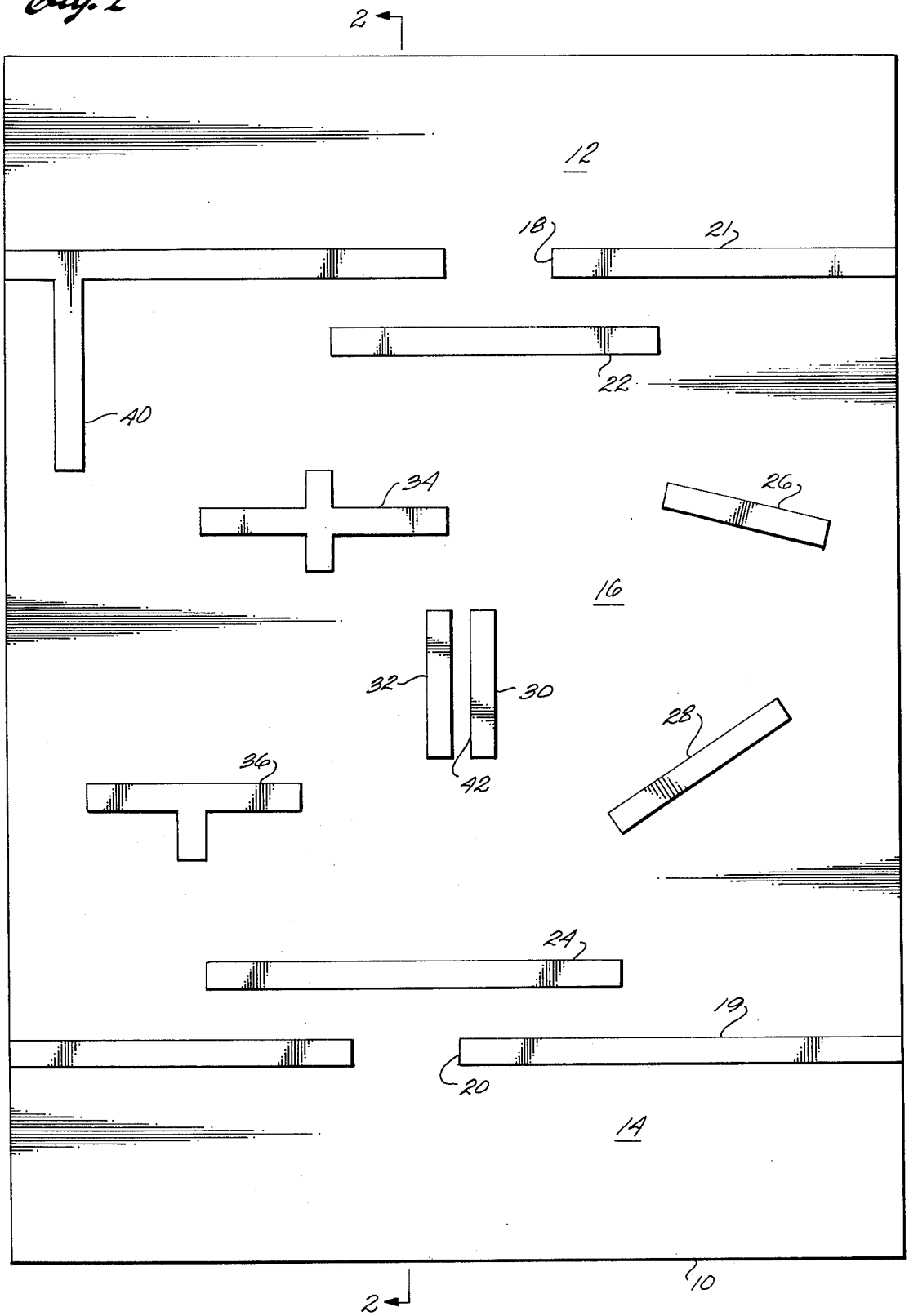
FIG. 1 is a front elevation view of a display apparatus according to the present invention.

DESCRIPTION OF THE SPECIFIC EMBODIMENT:

Referring to FIG. 1, there is shown a front elevation view of the arrangement of the apparatus of the present invention prior to the introduction of the immiscible liquids which are used with this device. As shown therein, the invention comprises a housing 10 defining a first reservoir 12 at the top of the housing, a second reservoir 14 at the bottom; and a main chamber 16 located between the two reservoirs. An opening 18 in reservoir 12 defines an aperture for the entry and exit of the liquids which are located within the container of this display device. A similar aperture 20 is provided for reservoir 14.

Located opposite aperture 18 is a baffle 22 and located opposite aperture 20 is a baffle 24. The baffles located opposite the openings from the reservoirs are positioned a sufficient distance therefrom so as to allow a significant amount of the liquid of heavier specific gravity to flow through the aperture and be deposited upon the baffle before slowly flowing outward toward the sides of the display device. The spacing of the baffles is selected to assist in defining the flow path from the reservoir and to being the process of breaking the single stream from the reservoir into the multiplicity of streams which result in the active dynamic visual display characteristic of the present invention. In one embodiment, baffles 22, 24 are centered with respect to apertures 18, 20 to produce an equal flow of liquid in both directions along the baffle when the apparatus is horizontally disposed.

As can be seen from the drawing, a plurality of obstructions 26, 28, 30, 32, 34, 36 are located in vertical fluid flow paths extending from the edges of baffles 22 and 24 respectively. By virtue of their orientation and configuration, different action is produced by each obstruction as beads of liquid descending from baffles 22 and 24 encounter the obstruction and flow under the influence of gravity in the direction controlled by the obstruction.

Figure 3A:
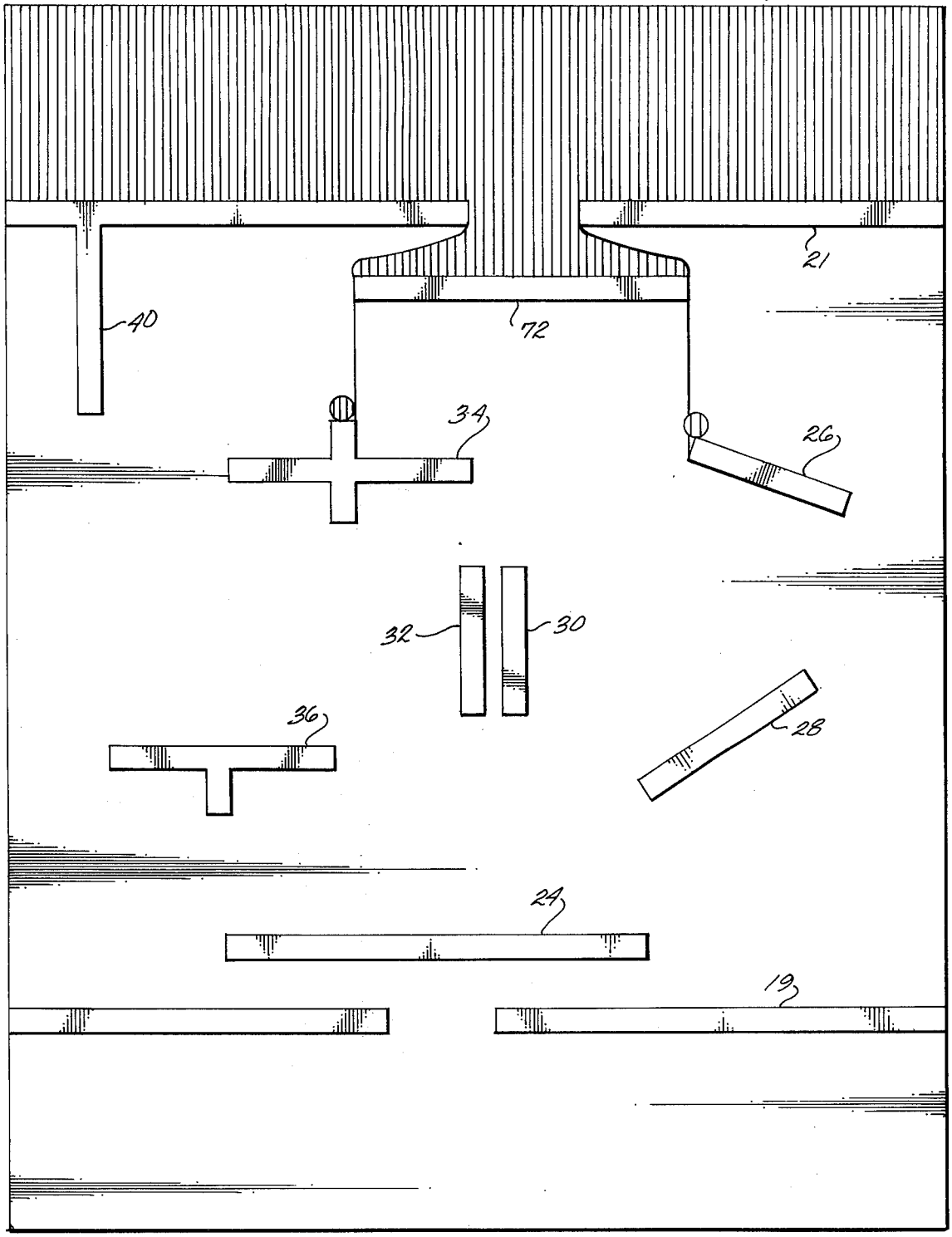
FIG. 3A is a front elevation view of the apparatus of FIG. 1 illustrating the flow path of the liquid beads when the apparatus is in a first orientation.
Figure 3B:
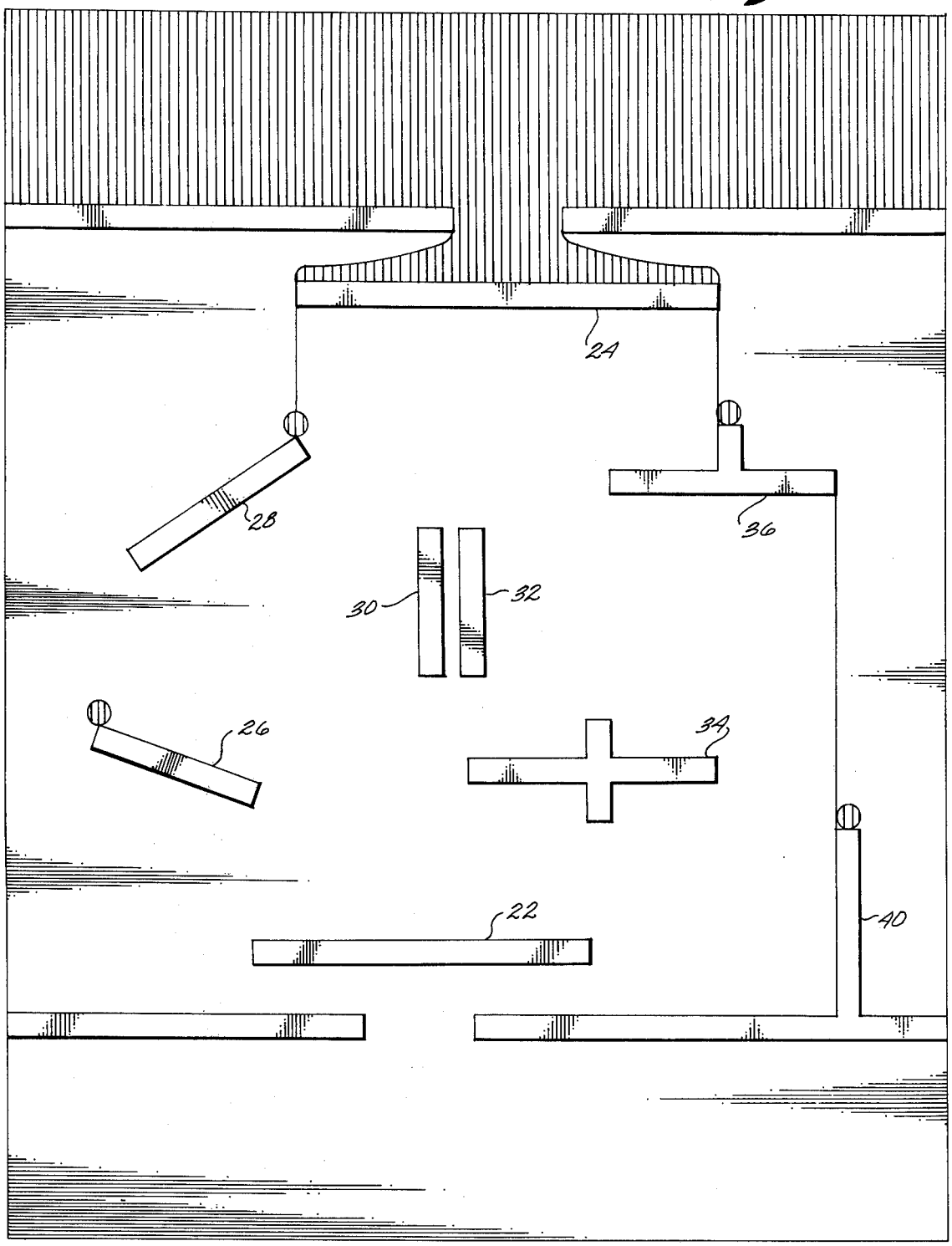
FIG. 3B is a front elevation view of the apparatus of FIG. 1 when the apparatus is in the reverse orientation.

As reference to FIGS. 1 and 3A and 3B show, obstructions 26, 28 produce a flow toward the outside of the display device with the beads thereafter falling to barriers 19, 21 which define apertures 18, 20 in reservoirs 12, 14. Beads of liquid falling along the flow path from the end of baffle 22 nearest cross-shaped obstruction 34 first encounter the top of the obstruction. Beads descending from the same end of baffle 22 will fall either to the right or to the left of the top of the cross and begin to build up on the cross arms of obstruction 34. A buildup of a certain volume on the cross arms of obstruction 34 will result in beads of liquid being formed and falling from the ends of the cross arms.

Beads falling from the end of obstruction 34 nearest vertical obstructions 30, 32 descend to and pass into the channel 42 defined by obstructions 30 and 32. Beads falling from the other end of obstruction 34 impinge upon the surface of a T-shaped obstruction 36, producing a liquid buildup similar to that which occurs on the baffles 22, 24 and the cross arms of obstruction 34. The buildup on obstrucion 36 continues until beads of liquid are caused to begin to fall off of the ends of obstruction 36 and onto barrier 19. As the heavier liquid descends, it displaces the lighter liquid causing it to flow upward and ultimately to replace the heavier liquid in reservoir 12. FIG. 3B. illustrates the flow pattern of liquid beads when the apparatus is inverted and the liquid of greater specific gravity is caused to flow from reservoir 14 toward reservoir 12. The beads of the heavier liquid are cross-hatched in FIGS. 3A and 3B to emphasize their color. The fluid of the lighter specific gravity which fills the remainder of the interior of the apparatus is likewise normally colored in a contrasting color. The second liquid has not been cross-hatched to aid in examining the drawing and to avoid unnecessary cluttering of these two figures.

Figure 2:
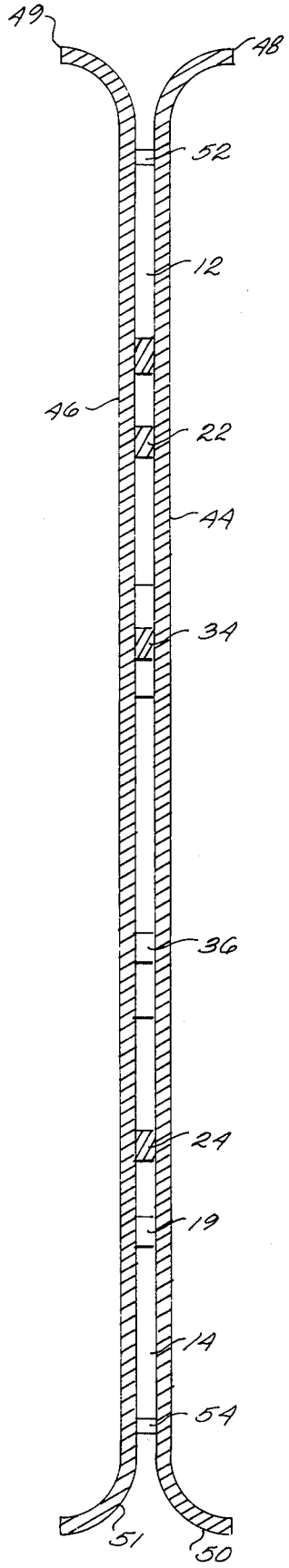
FIG. 2 is a side elevation view of the apparatus FIG. 1 taken along lines 2—2 of FIG. 1.

The closely spaced apart configuration of the plates defining the container of the present invention are shown in FIG. 2, a view of the apparatus of FIG. 1 taken along lines 2—2 thereof. As shown therein, the container comprises a first pane or plate, 44, and a second pane or plate, 46. In this embodiment panes 44, 46 extend beyond the ends of the container and are shaped to define supports 48, 49, 50, 51. The container is sealed along the outside edge of reservoirs 12, 14. As the display device is inverted each time, the pair of supports at each end are placed on a horizontal surface and the flow of the liquid of the heavier specific gravity from one reservoir 12 toward the other begins. Various obstructions in the fluid flow path are also shown in FIG. 2. These include the boundary 21 of reservoir 12, baffle 22, cross-shaped obstruction 34, T-shaped obstruction 36, baffle 24 and the boundary strip 19 of reservoir 14.

In the presently preferred embodiment of the invention panes or plates 44, 46 are fabricated of an acrylic material. Likewise panes or plates of other transparent and translucent materials can also be used to provide the display device of the present invention. The various boundaries, baffles, obstructions and sealed edges are obtained by solvent welding of strips of acrylic material in the position shown in the drawing. Fabrication by injection molding is also contemplated. Glycerin, a water miscible, oil immiscible liquid, is the presently preferred liquid of the heavier specific gravity. A light white oil designated Risella 911, manufactured by Shell Oil Co. is the presently preferred second liquid of lighter specific gravity. Contrasting coloring dyes are added to the glycerin and to the Risella 911 oil to permit the visual observation of the flow of the liquid of one specific gravity with respect to the liquid of the second specific gravity. In the case of the glycerin and the Risella 911 oil the specific gravities are 1.26 and 0.87 respectively.

Dyes which have been found suitable for use in glycerin are ordinary food coloring dyes. Typically a red dye is added to the glycerin. The addition of the dye is accomplished by placing the dye in a solution of propylene glycol and adding it to the glycerin. Candlemaking dyes are used to color the oil. Typically a blue dye is used and the addition of the dye to the oil is accomplished by placing it in solution in xylene and then adding it to the Risella oil.

It has been found that the beading of the heavier liquid in the lighter liquid is also related to the viscosity of the lighter liquid. Viscosities in the range of 40 to 60 have been found to be satisfactory. Risella 911 has a viscosity of 48 at 100° F Saybolt.

What has been described is a display device for producing visual effects suitable for use as a toy and novelty device. The invention utilizes two liquids, a water miscible, oil immiscible liquid of a heavier, first specific gravity and an oil of a lighter, second specific gravity. Glycerin and Risella 911 oil have been disclosed as examples of the two liquids, respectively. These details and the other details of the invention are by way of example of the scope of the invention as defined in the following claims.

What is claimed is:

1. A display apparatus comprising:

a sealed container defined by two closely spaced apart transparent or translucent plates having a main chamber and at least one reservoir located at one end of the chamber, the reservoir having at least one aperture opening into the main chamber;

a first liquid of a first specific gravity contained within the container;

a second liquid of a second specific gravity lighter than the said first specific gravity contained within the container, the second liquid being immiscible with said first liquid and having a predtermined viscosity; and at least one obstruction of a thickness equal to the depth of the main chamber disposed in the main chamber in a liquid flow path extending from the aperture, the obstruction being oriented within the chamber such that the first liquid is caused to be broken into beads of liquid as it moves past the obstruction.

2. A display apparatus according to claim 1 wherein the viscosity of the second liquid is selected such that the beading action of the first liquid is enhanced.

3. A display apparatus according to claim 1 wherein the first liquid is a water miscible, oil immiscible liquid and the second liquid is an oil.

4. A display apparatus according to claim 1 including a reservoir having at least one aperture located at opposite ends of the chamber whereby the action of the apparatus is reversible.

5. A display apparatus according to claim 4 wherein a baffle is located opposite each reservoir aperture and oriented such that the first liquid flowing through said aperture is broken into two or more streams of liquid beads.

6. A display apparatus according to claim 5 wherein the obstruction in the main chamber is located intermediate the baffles and oriented such that the liquid beads flowing from the end of the baffle encounter the obstruction.

7. A display apparatus according to claim 6 wherein the obstruction is asymetrically disposed within the chamber such that a different flow pattern of liquid beads is produced each time the orientation of the apparatus is reversed.

8. A display apparatus according to claim 7 inluding a plurality of obstructions of different configurations located within the main chamber.

9. A display apparatus according to claim 8 wherein the translucent plates are fabricated of a transparent acrylic material, the first liquid is glycerin and the second liquid is a light oil.

10. A display apparatus according to claim 9 including a first coloring agent added to the first liquid and a second, contrasting coloring agent added to the second liquid.

11. A display apparatus according to claim 10 including a support means for the apparatus whereby the apparatus may be inverted and displayed on a horizontal surface.

12. A display apparatus comprising:

a sealed container defined by two thin, closely spaced apart transparent or translucent plates having a main chamber and at least one reservoir located at one end of the chamber, the spacing of the two plates being approximately equal to the thickness of one of said plates and the reservoir having at least one aperture opening into the main chamber.

a first liquid of a first specific gravity contained within the container, a second liquid of a second specific gravity lighter than said first specific gravity contained within the container, the second liquid being immiscible with said first liquid and having a predetermined viscosity, and at least one obstruction disposed in the main chamber in a liquid flow path extending from the aperture, the obstruction being oriented within the chamber such that the flow of the first liquid is diverted as it encounters the obstruction.

13. A display apparatus according to claim 12 wherein the viscosity of the second liquid is selected such that the first liquid is broken into individual beads as it moves past the obstruction.

* * * * *

UNITED STATES PATENT AND TRADEMARK OFFICE

CERTIFICATE OF CORRECTION

PATENT NO. : 4,034,493

DATED : July 12, 1977

INVENTOR(S) : Derek W. Ball

It is certified that error appears in the above-identified patent and that said Letters Patent are hereby corrected as shown below:

Column 1, line 17, before "this" insert -- In --; line 52, "beacuse" should read -- because --; line 63, "single" should read -- singly --. Column 2, line 30, "obstrucion" should read -- obstruction --; line 66, "housing," should read -- housing; --. Column 3, line 51, "obstrucion" should read -- obstruction --. Column 4, line 25, "position" should read -- positions --; line 29-30, "ligh-ter" should read -- light-er --. Column 5, line 6, "predtermined" should read -- predetermined --. Column 6, line 1, "inluding" should read -- including --.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*